US009556561B2

(12) United States Patent
Nelvig et al.

(10) Patent No.: US 9,556,561 B2
(45) Date of Patent: Jan. 31, 2017

(54) STACK OF A PLURALITY OF CELLULOSE-CONTAINING ABSORBENT TOWELS AND A PROCESS FOR MANUFACTURING THE STACK

(75) Inventors: Anna Nelvig, Göteborg (SE); Fredrik Welander, Göteborg (SE); Magnus Falk, Onsala (SE); Robert Kling, Skene (SE); Anders Andersson, Stenungsund (SE); Per Möller, Borlänge (SE); Martin Bonnevier, Borlänge (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 13/996,856

(22) PCT Filed: Dec. 22, 2010

(86) PCT No.: PCT/SE2010/051467

§ 371 (c)(1),
(2), (4) Date: Jun. 21, 2013

(87) PCT Pub. No.: WO2012/087211

PCT Pub. Date: Jun. 28, 2012

(65) Prior Publication Data

US 2013/0269893 A1 Oct. 17, 2013

(51) Int. Cl.
*A47K 10/16* (2006.01)
*D21H 27/00* (2006.01)
(Continued)

(52) U.S. Cl.
CPC ..... *D21H 5/00* (2013.01); *A47K 10/16* (2013.01); *B65B 63/02* (2013.01); *B65B 63/026* (2013.01);
(Continued)

(58) Field of Classification Search
CPC .. A47K 2010/428; A47K 10/16; B65H 45/24; B65H 45/06; B65D 65/10; B65D 75/02; B65D 83/08; D21H 27/002; D21H 5/00; B31D 1/04; Y10T 428/15; Y10S 206/812
See application file for complete search history.

(56) References Cited

U.S. PATENT DOCUMENTS 2,741,361 A 4/1956 Klein
2,960,023 A 11/1960 Greiner et al.
(Continued)

FOREIGN PATENT DOCUMENTS

CN 101646373 A 2/2010
EP 1 860 033 A1 11/2007
(Continued)

OTHER PUBLICATIONS

International Search Report (PCT/ISA/210) issued on Sep. 12, 2011, by the Swedish Patent Office as the International Searching Authority for International Application No. PCT/SE2010/051467.
(Continued)

*Primary Examiner* — Jose Fortuna
(74) *Attorney, Agent, or Firm* — Buchanan Ingersoll & Rooney P.C.

(57) ABSTRACT

A stack of a plurality of cellulose-containing absorbent towels for a dispenser is provided. The towels are separable upon dispensing. The stack is compressed to a predetermined density dependent on material choice.

14 Claims, 8 Drawing Sheets

(51) Int. Cl.

| | |
|---|---|
| ***B65H 45/06*** | (2006.01) |
| ***B65B 63/02*** | (2006.01) |
| ***B65D 19/38*** | (2006.01) |
| *A47K 10/42* | (2006.01) |

(52) U.S. Cl.
CPC ..... *B65D 19/38* (2013.01); *D21H 27/002* (2013.01); *A47K 2010/428* (2013.01)

(56) References Cited

U.S. PATENT DOCUMENTS

| | | | | |
|---|---|---|---|---|
| 3,120,172 | A * | 2/1964 | Enloe | B65B 63/026 100/41 |
| 3,172,563 | A * | 3/1965 | Harwood | A47K 10/421 156/183 |
| 3,172,564 | A * | 3/1965 | Peterson | B65H 45/24 156/183 |
| 3,291,678 | A * | 12/1966 | Enloe et al. | 162/113 |
| 3,432,936 | A * | 3/1969 | Greenhalgh | D21F 5/00 162/115 |
| 3,612,264 | A * | 10/1971 | Trunick | 206/449 |
| RE28,459 | E * | 7/1975 | Cole | D21F 5/18 162/115 |
| 4,417,670 | A | 11/1983 | Booher | |
| 5,143,249 | A * | 9/1992 | Saint Criq et al. | 221/34 |
| 5,265,758 | A * | 11/1993 | Saint Criq et al. | 221/35 |
| 5,417,912 | A * | 5/1995 | Merry | 264/320 |
| 5,535,887 | A * | 7/1996 | Young et al. | 206/494 |
| 5,540,354 | A * | 7/1996 | Annand | 221/52 |
| 5,656,134 | A * | 8/1997 | Marinack | B31F 1/126 162/281 |
| 5,851,353 | A * | 12/1998 | Fiscus | B31F 1/126 162/109 |
| 5,853,547 | A | 12/1998 | Ahrens et al. | |
| 6,077,590 | A * | 6/2000 | Archer | B31F 1/07 162/109 |
| 6,187,139 | B1 * | 2/2001 | Edwards | D21F 11/14 162/111 |
| 6,273,996 | B1 | 8/2001 | Hollenberg et al. | |
| 6,284,083 | B1 * | 9/2001 | Dahlquist | 156/201 |
| 6,432,267 | B1 * | 8/2002 | Watson | D21F 1/44 162/111 |
| 6,447,640 | B1 * | 9/2002 | Watson | D21F 5/18 162/101 |
| 6,602,575 | B2 * | 8/2003 | Lefevre Du Grosriez et al. | 428/124 |
| 7,294,230 | B2 * | 11/2007 | Flugge-Berendes | D21H 27/30 162/109 |
| 7,527,709 | B2 | 5/2009 | Lippi Alves Fernandes et al. | |
| 7,550,061 | B2 | 6/2009 | Walkenhaus et al. | |
| 7,744,726 | B2 | 6/2010 | Scherb et al. | |
| 7,807,022 | B2 * | 10/2010 | Hermans | D21F 11/006 162/111 |
| 8,205,748 | B2 * | 6/2012 | Long et al. | 206/494 |
| 8,389,092 | B2 * | 3/2013 | Andersson | 428/43 |
| 8,857,611 | B2 * | 10/2014 | Thorburn et al. | 206/233 |
| 2002/0074100 | A1 * | 6/2002 | Yeh | D21F 11/14 162/198 |
| 2005/0058807 | A1 * | 3/2005 | Hochtritt et al. | 428/126 |
| 2005/0103434 | A1 * | 5/2005 | Andersson et al. | 156/291 |
| 2006/0086472 | A1 * | 4/2006 | Hermans | D21F 11/006 162/111 |
| 2007/0107863 | A1 * | 5/2007 | Edwards | D21F 3/0218 162/111 |
| 2008/0248239 | A1 | 10/2008 | Pomeroy et al. | |
| 2010/0078444 | A1 * | 4/2010 | Shannon | B65D 83/0805 221/63 |
| 2010/0243504 | A1 | 9/2010 | Long et al. | |
| 2011/0095042 | A1 * | 4/2011 | Bandoh | 221/45 |
| 2012/0072018 | A1 * | 3/2012 | Norlund et al. | 700/231 |
| 2012/0156447 | A1 * | 6/2012 | Hein et al. | 428/195.1 |
| 2013/0269893 | A1 * | 10/2013 | Nelvig et al. | 162/111 |
| 2014/0037701 | A1 * | 2/2014 | Mellin et al. | 424/401 |
| 2014/0044917 | A1 * | 2/2014 | Formon et al. | 428/124 |
| 2014/0057069 | A1 * | 2/2014 | Huang et al. | 428/126 |
| 2014/0106117 | A1 * | 4/2014 | Hochtritt et al. | 428/126 |
| 2014/0135192 | A1 * | 5/2014 | Andersson et al. | 493/356 |
| 2014/0291186 | A1 * | 10/2014 | Andersson et al. | 206/449 |
| 2014/0361033 | A1 * | 12/2014 | Andersson | 221/33 |

FOREIGN PATENT DOCUMENTS

| | | | |
|---|---|---|---|
| GB | 958496 | A | 5/1964 |
| GB | 1011061 | A | 11/1965 |
| JP | 2001286414 | A | 10/2001 |
| SE | 310863 | B | 5/1969 |
| WO | WO 00/40405 | A1 | 7/2000 |
| WO | WO 02/40774 | A2 | 5/2002 |
| WO | 2010 008331 | A1 | 1/2010 |

OTHER PUBLICATIONS

Written Opinion (PCT/ISA/237) issued on Sep. 12, 2011, by the Swedish Patent Office as the International Searching Authority for International Application No. PCT/SE2010/051467.

International Preliminary Report on Patentability (PCT/IPEA/409) Issued on Feb. 8, 2013, by the Swedish Patent Office as the International Preliminary Examining Authority for International Application No. PCT/SE2010/051467.

Office Action issued by the Chinese Patent Office on Apr. 23, 2015 in corresponding Chinese Application No. 201080070843.9. (8 pages).

Extended European Search Report dated Nov. 22, 2016, issued by the European Patent Office in corresponding European Application No. EP 108610951 (11 pages).

* cited by examiner

STACK OF A PLURALITY OF CELLULOSE-CONTAINING ABSORBENT TOWELS AND A PROCESS FOR MANUFACTURING THE STACK

TECHNICAL FIELD

The present invention relates to a stack of a plurality of cellulose-containing absorbent towels for a dispenser, the towels being separable upon dispensing. The present invention also relates to a process for manufacturing a stack of a plurality of cellulose-containing towels for a dispenser.

BACKGROUND ART

Transportation of tissue paper bundles and similar products, folded or un-folded, includes transportation of substantial amounts of air between the sheets and plies of the products. Typically, densities for common dry crepe and TAD (Through Air Dried) in folded products range up to around 0.19 g/cm$^3$ and 0.15 g/cm$^3$ respectively.

For folded products, typical high end data for density is in the ranges:

Wet crepe: 0.26 g/cm$^3$

Dry crepe: 0.19 g/cm$^3$

TAD: 0.15 g/cm$^3$

NW: 0.18 g/cm$^3$

It has been a long-felt need to reduce the bulk of stacks of cellulose-containing hand towels. Some attempts have been made to compress the stack of hand towels and then wrap them with an enclosure wrap to keep them in somewhat compressed state during transportation and storage. This is known from for instance EP 1 860 033 A1.

SUMMARY

By heavy compression of the products before packing them in transport units on pallets, substantial cost saves are made due to the increased density and reduced pack dimensions and the fit of more products per pallet and truck. The object with the present disclosure is to significantly reduce the volume of stacked absorbent towels without sacrificing dispensing performance and without sacrificing performance with regards to the function of the towels, such as good absorption and wet strength. If this object is fulfilled one can reduce dispenser size with preserved capacity and/or increase capacity of today's system. There is also logistics and environmental gains in reducing stack height.

The present disclosure thus relates to a stack of a plurality of cellulose-containing absorbent towels for a dispenser characterized in that the stack has a high density dependent on choice of material. The towels (or tissue) are separable one by one from the stack upon dispensing. Here, "separable" means that the towels can be removed one by one from the stack by the hands of a user. Hence, the towels of the compressed stack should be possible to separate from each other at dispensing, so that a user will not get a clump or bunch of towels when he tries to pull one. Hence, the sheets must be loose or easily loosened from each other to slide off from the rest of the stack. Here, "cellulose-containing" refers to a material comprising cellulose in different amount. If the amount of cellulose is above 50% then the material is referred to as cellulose based.

According to one embodiment of the invention the stack comprises at least 50 of towels.

According to an embodiment of the invention the material choice gives the following data:

the towels (3) are made from Dry Crepe and wherein the density of the stack (2) is at least 0.25 g/cm$^3$, and preferably above 0.37 g/cm$^3$, and more preferably above 0.39 g/cm$^3$, or that:

the towels (3) are made from nonwoven and that the stack (2) has a density of at least 0.20 g/cm$^3$, and preferably above 0.25 g/cm$^3$, and more preferably above 0.32 g/cm$^3$, or that:

the towels (3) are produced with non-compressing de-watering technology and that the stack (2) has a density of at least 0.20 g/cm$^3$, and preferably above 0.25 g/cm$^3$ and more preferably above 0.32 g/cm$^3$, or that:

the towels (3) are made from Wet Crepe and wherein the density of the stack (2) is at least 0.30 g/cm$^3$, and preferably above 0.40 g/cm$^3$, and more preferably above 0.50 g/cm$^3$.

The method Wet Creped or Wet Pressed is known from, e.g. WO02/40774.

The non-compressing de-watering technology may be TAD (Thru-Air-Dried), UCTAD (Uncreped-Through-Air-Dried) or ATMOS (Advanced-Tissue-Molding-System:). The methods are known from prior art, for example TAD is known from U.S. Pat. No. 5,853,547; and ATMOS from U.S. Pat. No. 7,744,726, U.S. Pat. No. 7,550,061 and U.S. Pat. No. 7,527,709; and UCTAD from EP 1156925 and WO 02/40774.

According to one example, the towels are interfolded for dispensing purposes. Here, interfolded means that the towels are folded such that they "hook" into each other for allowing one towel to be partly dispensed or ready to be dispensed when the towel before is being dispensed.

The present disclosure includes a process for manufacturing a stack of a plurality of cellulose-containing towels for a dispenser, wherein the stack is conditioned to a predetermined moisture level and then compressed to the above described densities dependent on choice of material. The method comprises the step of applying a predetermined pressure for a predetermined time, the pressure and time being dependent on material in the towel and the moisture level of the material and that the compressed stack of towels should be separable upon dispensing.

The stack may be compressed from a non-compressed state or a partly compressed state.

According to one example of the process the moisture level should not exceed 5%.

According to an embodiment of the process the predetermined pressure should not exceed P 200 bar or $200\times10^5$ Pa (N/m$^2$).

Method for determining stack/bundle density:

Density is defined as weight per volume and reported in kg/m$^3$.

The stack is measured as received i.e. if it has a wrap of some kind that wrap is left on the bundle and is included in the result.

The bundle is conditioned in standard condition climate (23° C./50% RH) for at least 24 h.

Weight is measured to the nearest 0.1 g with a suitable calibrated scale.

The bundle is considered to have essentially planar surfaces that constitute the outer boundaries of its volume.

Relative position and size of these surfaces are determined by means of plates and sliding caliper as described below:

The bundle is positioned between two planar plates of a suitably rigid material to prevent bending (square steel plates 200×300 mm and 8 mm thick has been used)

The plates are fixed on guidance rods so they remain parallel (with an accuracy of +/−1 mm) and the upper plate can move along these guides.

The bundle is placed between the plates and the upper plate rests on the bundle so its weight rests on the stack.

The steel plate described above has a weight of approximately 4 kg (corresponding to a force of 40 N) that will on the most common stacks exert a pressure of approximately 2 KPa (+/−0.5 kPa). Should the pressure be outside this range, the load of the plates should be adjusted accordingly.

The distance between the plates (that defines the height of the stack) is determined with sliding caliper or other suitable device to an accuracy of 1%.

The outer dimensions of the stack in the two other principal directions (width and length) are determined also by sliding caliper while the stack is in the fixture as described above.

Measurement of length and width is made on at least five different positions equally distributed along the height of the stack and with essentially no compression of the stack from the sliding caliper.

The volume is defined as the volume of a rectangular parallelepiped that circumscribes the stack—determined with sliding caliper as described above—i.e. height×length×width.

A suitable sliding caliper is supplied by Mitutoyo with art no 552-150-10 which can be supplied with 200 mm measurement legs.

End of method.

The invention also relates to a transport package comprising a plurality of refill stacks of cellulose-containing absorbent towels for a dispenser. The towels are separable upon dispensing, and the transport package is arranged to be fitted on a rectangular pallet with a bottom area of 1200 mm×800 mm, and within a volume defined by the bottom area and the height of the transport package. The weight of the transport package divided with the volume of the transport package gives a transport package density. The transport density depends on material in the following manner:

- the towels are made from Dry Crepe and wherein the transport density is at least 0.32 g/cm$^3$, and preferably above 0.39 g/cm$^3$, and more preferably above 0.46 g/cm$^3$, or that:
- the towels are made from nonwoven and wherein the transport density is at least 0.32 g/cm$^3$, and preferably above 0.39 g/cm$^3$, and more preferably above 0.46 g/cm$^3$, or that:
- the towels are produced with non-compressing de-watering technology and wherein the transport density is at least 0.32 g/cm$^3$, and preferably above 0.39 g/cm$^3$ and more preferably above 0.46 g/cm$^3$, or that:
- the towels are made from Wet Crepe and wherein the transport density is at least 0.38 g/cm$^3$, and preferably above 0.46 g/cm$^3$, and more preferably above 0.55 g/cm$^3$.

BRIEF DESCRIPTION OF THE DRAWINGS

Embodiments of the invention will in the following be described with reference to drawings wherein.

DETAILED DESCRIPTION

Figure 1:
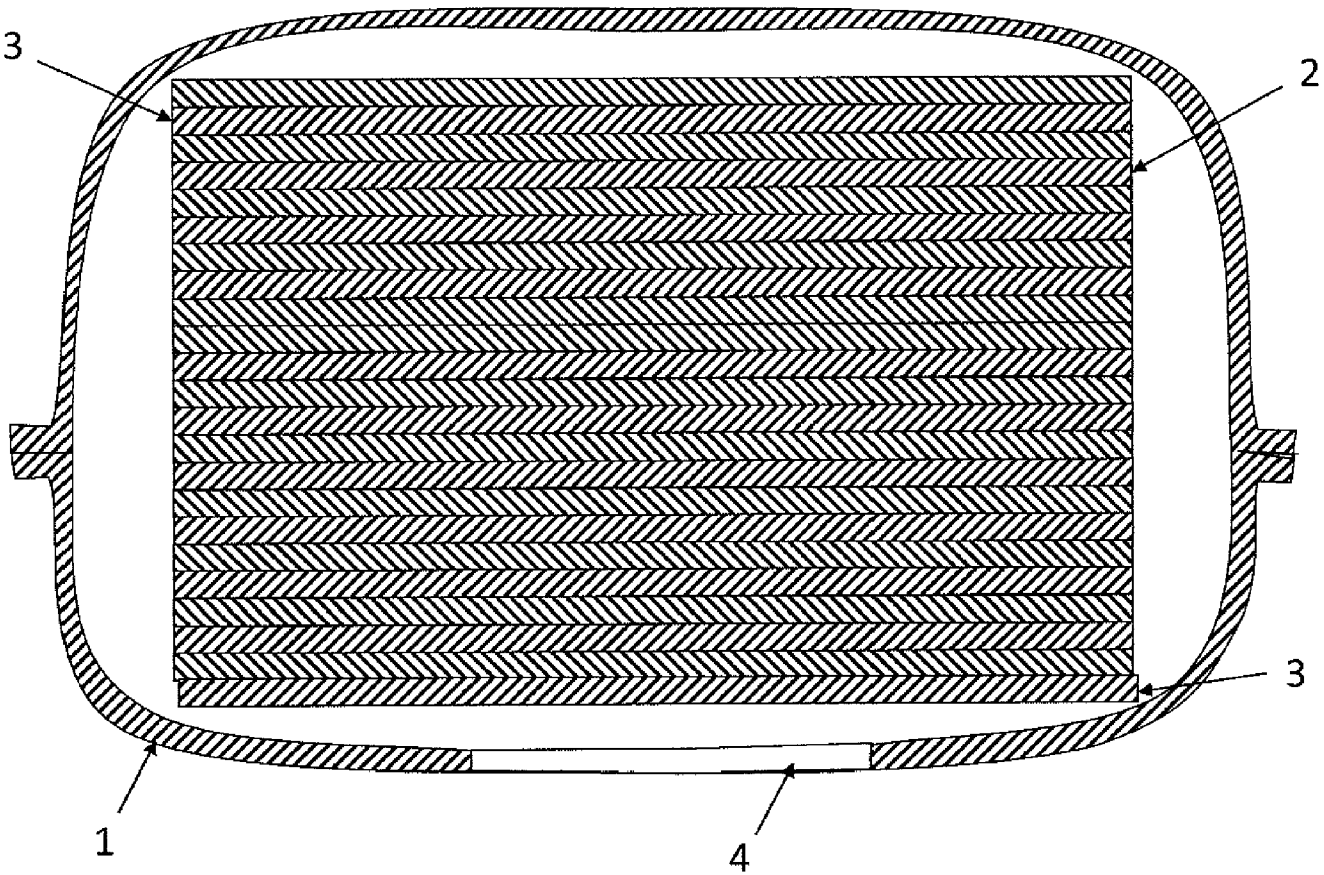
FIG. 1 is a schematic view of a dispenser with a stack of a plurality of absorbent towels in accordance with an embodiment of the invention.

FIG. 1 schematically shows a cross-section of a dispenser 1 for storing a stack 2 of a plurality of cellulose-containing absorbent towels 3 is. The dispenser is provided with an opening 4 through which individual towels can be drawn by a user.

Figure 2:
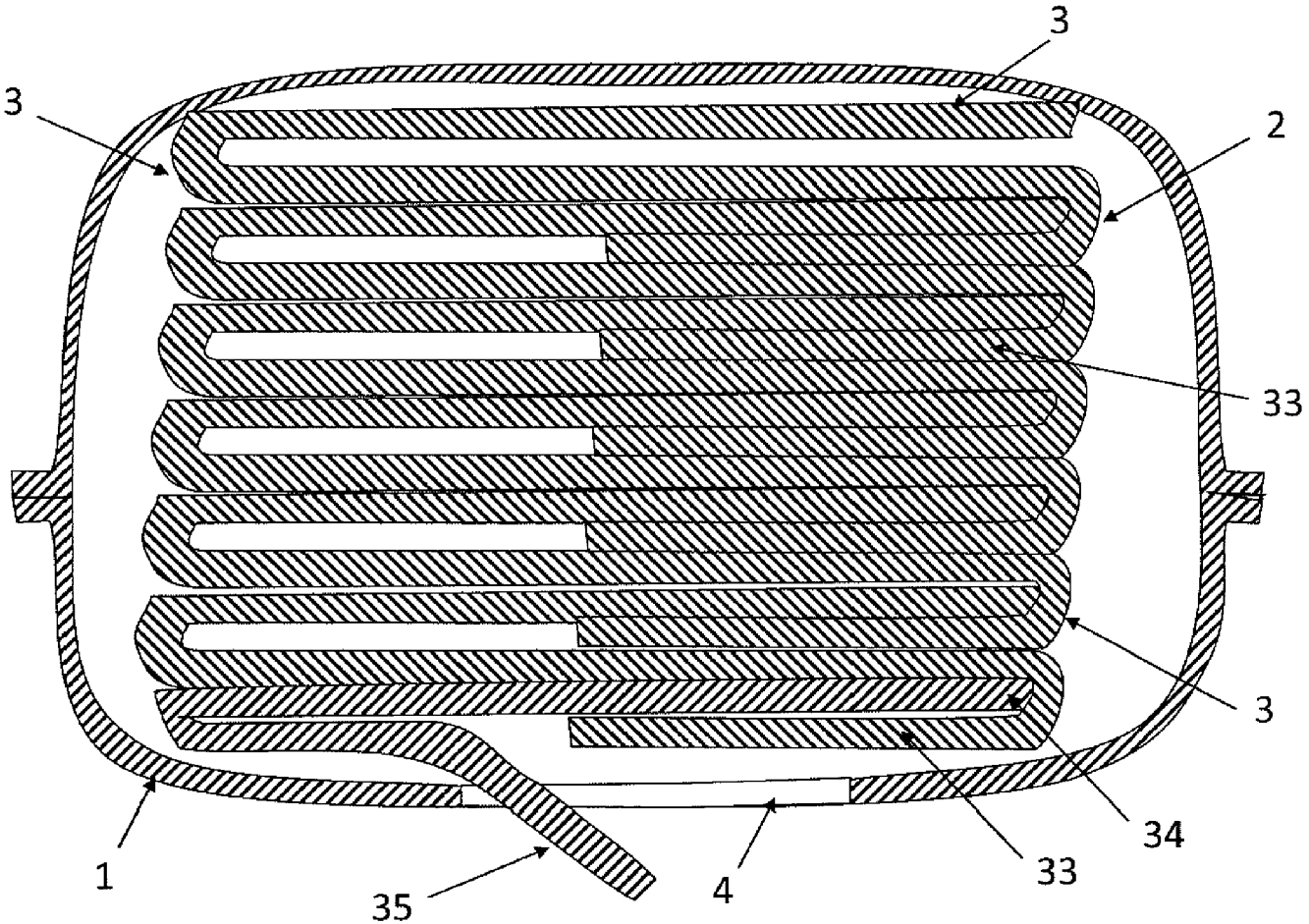
FIG. 2 is a schematic view of a dispenser with a stack of a plurality of interfolded absorbent towels in accordance with an embodiment of the invention.

FIG. 2 shows a dispenser with the same construction as in FIG. 1 and provided with the same reference numbers. A stack 2 of a plurality of cellulose-containing absorbent towels 3 is stored in the dispenser 1. The stack as shown in FIG. 2 differs from the stack according to FIG. 1 in that the towels are interfolded, which means that a front end part 33 of a towel in the stack, as seen in the direction out from the dispenser in FIG. 2, is folded over the back end part 34 of a towel in the stack. When the towel which with a part 35 extends out from the opening, as shown in FIG. 2, is drawn out from the dispenser 1 the front end part 33 of the next towel in the stack will be drawn along so that the front end 33 of said next towel in the stack is exposed outside the opening. The towels may be C-folded, which means that the towel is double folded with every second towel having the opening to "the right" and every other second having the opening to "the left" such that the stacked towels grip into each other. The towels may also be Z-folded, i.e. folded three times and arranged such that they grip into each other. Further folding and stacking possibilities known from prior art can be compressed according to an embodiment of the invention.

Hence, stacks 2 of the type as shown in FIGS. 1 and 2 are with regards to the folding and interfolding of the towels in principle earlier known. The main difference is that the stacks in accordance with the present disclosure is heavily compressed compared to stacks according to prior art.

The stacks 2 are compressed under conditions such that the stacks can be arranged and used in dispensers without sacrificing dispensing performance and without sacrificing performance with regards to the function of the towels, such as good absorption and wet strength.

The stack is according to an embodiment of the invention compressed to a predetermined density dependent on choice of material. Said density is calculated by measuring the weight and the volume of the stack.

The stack may consist of a connected web arranged in zigzag with the individual towels along the web being separated and separable upon dispensing. This embodiment is not shown in the drawings.

The stack may also be formed from a continuous web which is provided with perforations between each individual towel, whereby individual towels can be withdrawn from the dispenser by tearing along the perforations.

Alternatively the stack may be formed from a continuous web without perforations. Instead the dispenser is provided with a tear edge, such as a toothed edge, along with which the web can be cut by a user for producing separate towels.

According to an embodiment of the invention, the towels or tissues arranged as described above are separable one by one upon dispensing.

According to an embodiment of the invention the material choice gives the following data:

- the towels (3) are made from Dry Crepe and wherein the density of the stack (2) is at least 0.25 g/cm$^3$, and preferably above 0.37 g/cm$^3$, and more preferably above 0.39 g/cm$^3$, or that:
- the towels (3) are made from nonwoven and that the stack (2) has a density of at least 0.20 g/cm$^3$, and preferably above 0.25 g/cm$^3$, and more preferably above 0.32 g/cm$^3$, or that:
- the towels (3) are produced with non-compressing de-watering technology and that the stack (2) has a density of at least 0.20 g/cm$^3$, and preferably above 0.25 g/cm$^3$ and more preferably above 0.32 g/cm$^3$, or that:
- the towels (3) are made from Wet Crepe and wherein the density of the stack (2) is at least 0.30 g/cm$^3$, and preferably above 0.40 g/cm$^3$, and more preferably above 0.50 g/cm$^3$.

Figure 3:
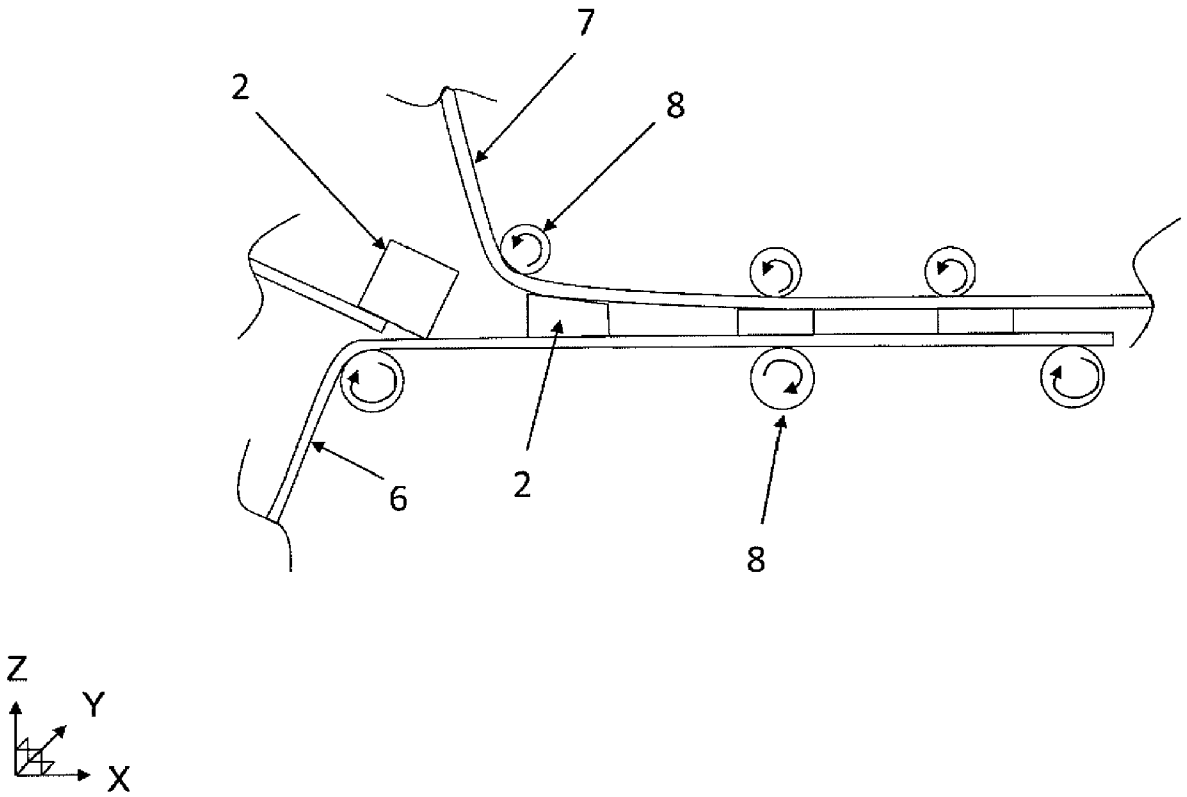
FIG. 3 illustrates a first example of a method according to an embodiment of the invention for compressing a stack of absorbent towels.

In FIG. 3 is shown a first example of a method for compressing stacks of absorbent towels. The stacks are compacted between conveyor belts 6 and 7 which are supported by pressure-loaded rolls 8. In FIG. 3 the top belt 7 is arranged in inclination and the stacks are gradually compacted between the conveyor belts 7 and 8.

The stack 2 is conditioned to a predetermined moisture level and then compressed to a density of at least 0.31 g/cm$^3$. The method comprises the step of applying a predetermined pressure for a predetermined time. The pressure and time being dependent on material in the towel 3 and the moisture level of the material. One important parameter is that the compressed stack of towels should be separable upon dispensing.

Alternatively, not shown, the top belt can be horizontal and the bottom belt arranged in inclination or both belts could be arranged in inclination.

Figure 4:
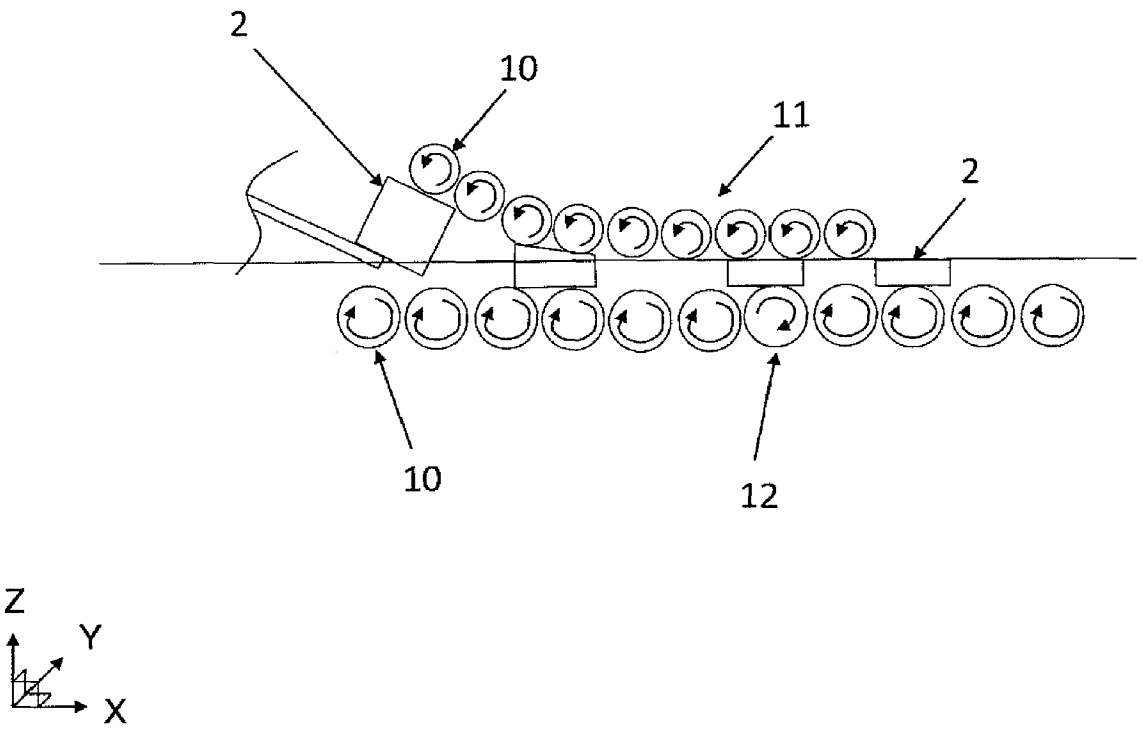
FIG. 4 illustrates a second example of a method according to an embodiment of the invention for compressing a stack of absorbent towels.

In FIG. 4 a second example of a method for compacting a stack of towels is illustrated. The stacks are compacted by means of pressure-loading rotating rolls arranged in series after each other. In the shown embodiment the rolls are arranged in an upper series 11 and in a lower series 12. The upper series is in FIG. 4 arranged in inclination and the lower series is arranged along a horizontal line, whereby the stacks are gradually compacted between the upper and lower series of rolls 10.

Alternatively, not shown, the upper series of rolls can be horizontal and the lower series arranged in inclination or both series can be arranged in inclination.

Figure 5:
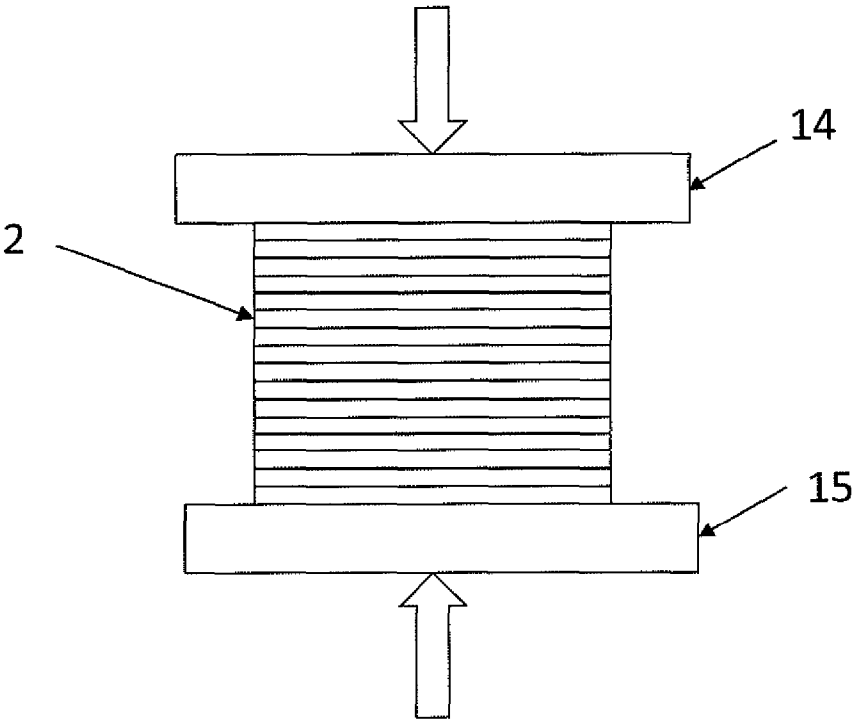
FIG. 5 illustrates a third example of a method according to an embodiment of the invention for compressing a stack of absorbent towels.

In FIG. 5 is schematically illustrated how a stack 2 can be compressed between two plates 14 and 15 by means of hydraulic press or any other press, such as mechanical press, possibly eccentric press. In the embodiment according to FIG. 5 the stacks 2 is compacted one at a time between the two plates.

Figure 6:
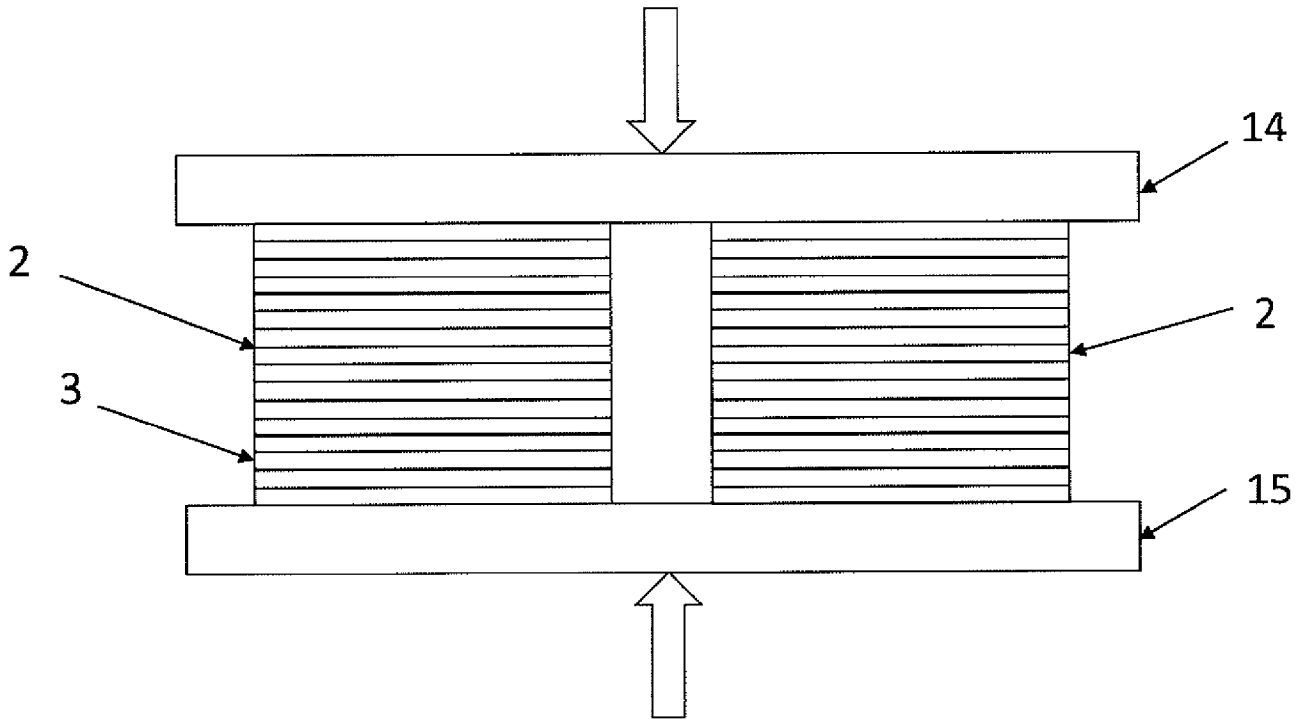
FIG. 6 illustrates a fourth example of a method according to an embodiment of the invention for compressing stacks of absorbent towels.

In FIG. 6 is schematically shown a fourth method of compressing stacks 2. Here two stacks 2 at a time are compacted between two plates 14 and 15.

Figure 7:
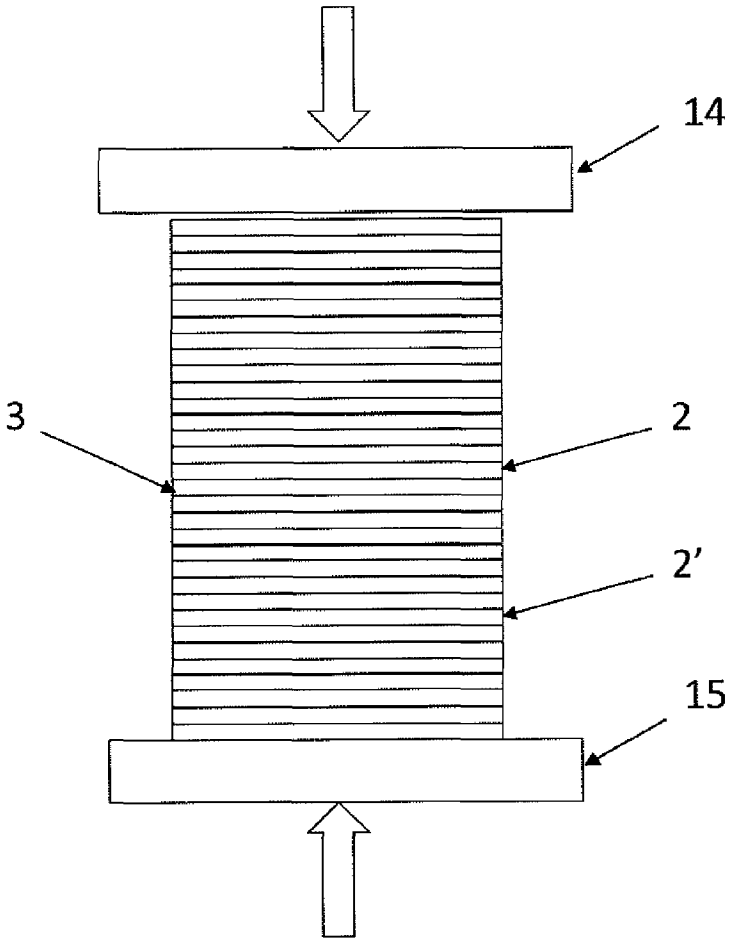
FIG. 7 illustrates a fifth example of a method according to an embodiment of the invention for compressing stacks of absorbent towels.

In FIG. 7 is schematically shown a modified method where two stacks 2 and 2' are arranged one on top of the other and compressed together.

Figure 8:
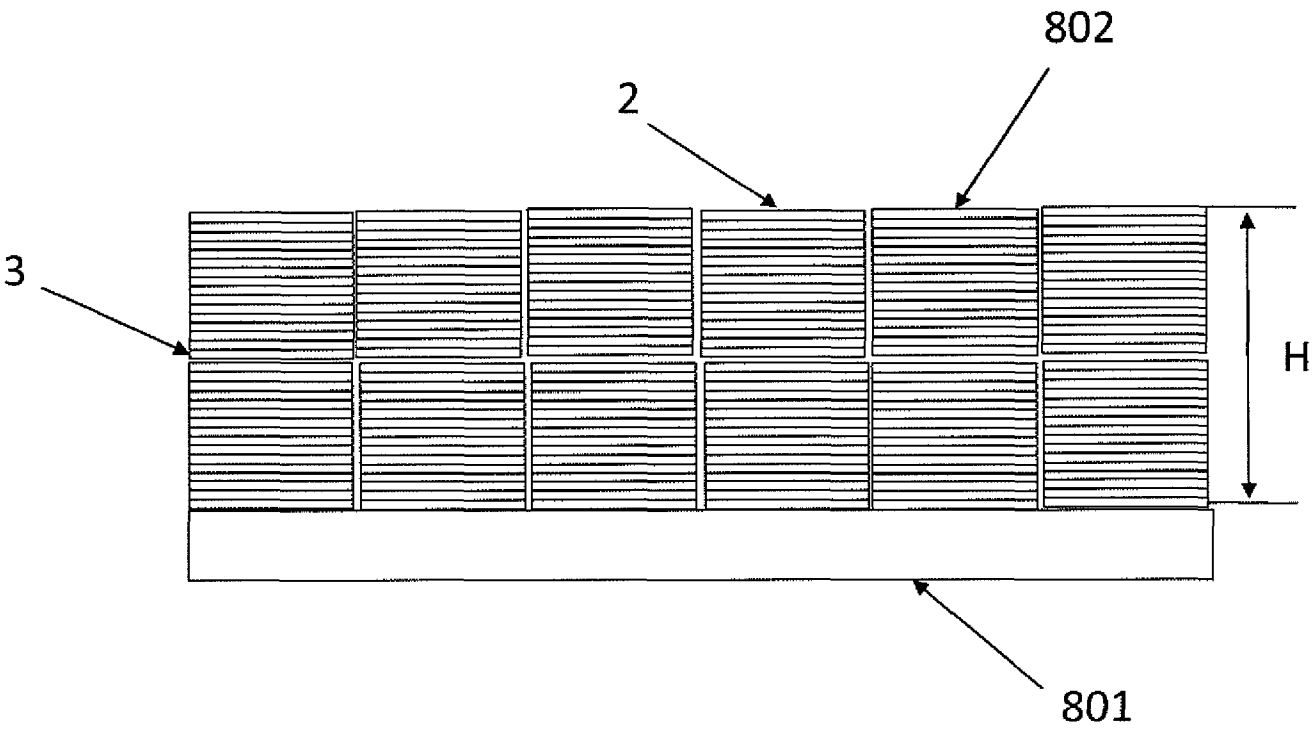
FIG. 8 schematically shows a transport package comprising a plurality of refill stacks of cellulose-containing absorbent towels for a dispenser, according to an embodiment of the invention.

In FIG. 8 is schematically shown a transport package 802 comprising a plurality of refill stacks 2 of cellulose-containing absorbent towels 3 for a dispenser 1. The towels are separable upon dispensing, and the transport package is arranged to be fitted on a rectangular pallet 801 with a bottom area of 1200 mm×800 mm, and within a volume defined by the bottom area and the height H of the transport package. The weight of the transport package divided with the volume of the transport package gives a transport package density. The transport density depends on material in the following manner:

- the towels 3 are made from Dry Crepe and wherein the transport density is at least 0.32 g/cm$^3$, and preferably above 0.39 g/cm$^3$, and more preferably above 0.46 g/cm$^3$, or that:
- the towels 3 are made from nonwoven and wherein the transport density is at least 0.32 g/cm$^3$, and preferably above 0.39 g/cm$^3$, and more preferably above 0.46 g/cm$^3$, or that:
- the towels 3 are produced with non-compressing de-watering technology and wherein the transport density is at least 0.32 g/cm$^3$, and preferably above 0.39 g/cm$^3$ and more preferably above 0.46 g/cm$^3$, or that:
- the towels 3 are made from Wet Crepe and wherein the transport density is at least 0.38 g/cm$^3$, and preferably above 0.46 g/cm$^3$, and more preferably above 0.55 g/cm$^3$.

It should be noted that the refill stacks refer to stacks or bundles as described in connection to FIGS. 1-7, but also for rolls.

The present invention is not restricted to the above described embodiments. A lot of alternative and modifications are possible within the scope of the following claims.

It should be understood from the description that the term "towel" includes different types of cellulose-containing materials such as for instance tissue.

An alternative method of compacting stacks of towels is to use vacuum or any other means of applying pressure on the stacks.

All means of applying pressure/compressing the stacks may be combined with pre-calendaring, and may be performed in several steps.

All means of applying pressure/compressing the stacks may be combined with adjusting moisture to the product in different levels, before after or during compression.

The compression can be performed step by step, linear or non-linear.

The invention claimed is:

1. A stack of a plurality of cellulose-containing absorbent towels for a dispenser, the towels being separable upon dispensing, and the towels are produced with non-compressing de-watering technology and the stack has a density of at least 0.20 g/cm$^3$.

2. A stack according to claim 1, wherein the non-compressing de-watering technology is one of Through-Air-Dried (TAD), Uncreped-Through-Air-Dried (UCTAD), and Advanced-Tissue-Molding-System (ATMOS) technology.

3. A stack according to claim 2, wherein the towels are separable one by one from the stack upon dispensing.

4. A stack according to claim 2, wherein the stack comprises at least 50 towels.

5. A stack according to claim 2, wherein the towels for dispensing are interfolded.

6. A stack according to claim 2, wherein the towels are produced with non-compressing de-watering technology and the stack has a density above 0.25 g/cm$^3$.

7. A stack according to claim 2, wherein the towels are produced with non-compressing de-watering technology and the stack has a density above 0.32 g/cm$^3$.

8. A stack according to claim 2, wherein the towels are arranged in a continuous web which is perforated between separate towels.

9. A stack according to claim 1, wherein the towels are separable one by one from the stack upon dispensing.

10. A stack according to claim 1, wherein the stack comprises at least 50 towels.

11. A stack according to claim 1, wherein the towels for dispensing are interfolded.

12. A stack according to claim 1, wherein the towels are produced with non-compressing de-watering technology and the stack has a density above 0.25 g/cm$^3$.

13. A stack according to claim 1, wherein the towels are produced with non-compressing de-watering technology and the stack has a density above 0.32 g/cm$^3$.

14. A stack according to claim 1, wherein the towels are arranged in a continuous web which is perforated between separate towels.

* * * * *